US006360444B1

(12) United States Patent
Fluhr et al.

(10) Patent No.: US 6,360,444 B1
(45) Date of Patent: Mar. 26, 2002

(54) METHOD AND APPARATUS FOR OPENING CONTAINERS AND REDUCING WASTE FROM CONTAINERS

(76) Inventors: Steven P. Fluhr, 2909 Roberta, San Jose, CA (US) 95121; David M. Evjen, 16305 Matilija Dr., Monte Sereno, CA (US) 95030; Don Noren, 98 Belbrook Ave., Atherton, CA (US) 94027

( * ) Notice: Subject to any disclaimer, the term of this patent is extended or adjusted under 35 U.S.C. 154(b) by 0 days.

(21) Appl. No.: 09/197,353

(22) Filed: Nov. 20, 1998

Related U.S. Application Data

(60) Provisional application No. 60/066,351, filed on Nov. 21, 1997.

(51) Int. Cl.[7] ..... B26F 1/00; B67B 7/48

(52) U.S. Cl. ..... 30/366; 30/450; 81/3.47; 7/151

(58) Field of Search ..... 30/407, 414, 443, 30/445, 449, 450, 358, 366; 81/3.47, 3.48, 3.49; 7/151, 152, 156

(56) References Cited

U.S. PATENT DOCUMENTS

| | | | | |
|---|---|---|---|---|
| 2,582,947 A | | 1/1952 | Burnard | 81/3.1 |
| 3,618,673 A | * | 11/1971 | Gossett | 172/371 |
| 4,580,302 A | | 4/1986 | Barth | 7/152 |
| 4,631,769 A | | 12/1986 | White | 7/151 |
| 5,127,121 A | | 7/1992 | Bossie | 7/143 |
| 5,212,869 A | | 5/1993 | Zacharchuk | 30/366 |
| 5,449,374 A | * | 9/1995 | Dunn et al. | 606/208 |
| 5,568,665 A | | 10/1996 | Fick | 7/105 |

FOREIGN PATENT DOCUMENTS

| | | | |
|---|---|---|---|
| GB | 2 220 928 A | 1/1990 | B67B/7/12 |

* cited by examiner

*Primary Examiner*—D. S. Meislin
(74) *Attorney, Agent, or Firm*—David J. Weitz; Wilson Sonsini Goodrich & Rosati

(57) ABSTRACT

A method and apparatus for opening containers and reducing waste from containers are described. The apparatus includes an opener device and a puncture device. The opener device facilitates the removal of a lid from a container without damaging the lid or the containers. The puncture device is capable of creating one or more holes in the container channel of the container to allow liquid trapped in the container channel to drain back into the container.

7 Claims, 11 Drawing Sheets

METHOD AND APPARATUS FOR OPENING CONTAINERS AND REDUCING WASTE FROM CONTAINERS

CROSS-REFERENCE TO RELATED APPLICATION

This application claims priority to and incorporates by reference the U.S. Provisional patent application entitled OPENER DEVICE AND METHOD FOR AVOIDING MATERIAL WASTE AND BUILD-UP ON A CONTAINER LIP, Ser. No. 60/066,351, filed Nov. 21, 1997, and invented by Steven P. Fluhr.

BACKGROUND OF THE INVENTION

1. Field of the Invention

The present invention relates to a method and apparatus for opening containers and reducing waste from containers. More particularly, the present invention relates to a method and apparatus for opening liquid containers and reducing liquid waste and buildup on the lip of the liquid container.

2. Description of Related Art

Various tools are used to remove the lid from liquid containers such as paint cans, stain cans, primer cans, and other similar liquid containers. These liquid containers include an outer surface which meet a container lip at a container bead. The container lip includes a container channel. The lid includes a lid channel which press fits into the container channel and seals the liquid container. The lid also includes a lid bead which defines a gap with the container lip and facilitates removal of the lid.

A flathead screwdriver or similar object is often used to remove the lid by inserting the tip of the screwdriver into the gap and prying the lid from the liquid container. However, this often damages the liquid container and/or lid because [insert reasons here] and makes it harder to reseal the lid to the liquid container. Furthermore, the screwdriver is susceptible to slipping and injuring the user.

Various tools are used to create drainage holes in the container channel of a liquid container to allow liquid trapped in the container channel to drain back into the liquid container. This occurs as a brush is removed from a liquid container and excess liquid is removed from the brush by easing the brush out of the liquid container along the container lip. As the process is repeated several times during a session of painting or the like, liquid tends to build up inside the container channel. This liquid build-up tends to flow over the lip and down the outside surface of the liquid container. This wastes the liquid from the liquid container and produces a mess, and also creates a problem when reattaching the lid. If left to dry with the lid in place, it becomes more difficult to remove the lid later. Alternatively, wiping off the container channel with a cloth to avoid build-up is difficult due to the small width of the container channel and wastes additional liquid onto the cloth. The same wasteful condition exists when the liquid is poured out of the liquid container because the liquid accumulates in the container channel, flows over the side, and is difficult to clean up without mess and waste.

To at least partially alleviate this problem, painters often use a nail and a hammer to create drainage holes in the bottom of the container channel so that excess liquid can flow back into the liquid container. Various punches are also sometimes used with a hammer. However, the use of a nail or punch requires impact which often deforms the container channel and makes it harder to reseal the lid to the liquid container. Other devices use leverage instead of impact, but still use a sharp point which may accidentally injure the user. Furthermore, these devices form drainage holes at the bottom of the container channel, and exposes the user to sharp edges on the inside of the liquid container.

What is needed is a method and apparatus for opening liquid containers safely and reliably. What is also needed is a method and apparatus for opening liquid containers without damaging the liquid container or the lid.

What is needed is a method and apparatus for creating drainage holes in a container channel safely and reliably. What is also needed is a method and apparatus for creating drainage holes in a container channel without damaging the liquid container or the lid. What is also needed is a method and apparatus for creating drainage holes in a container channel which minimizes sharp edges exposed to a user.

SUMMARY OF THE INVENTION

A device for removing a lid from a container, the container having an outer surface, a container bead, and a container lip, the outer surface meeting the container lip at the container bead, the container lip having a container channel, the lid having a lid channel and a lid bead, the lid channel configured to be inserted into the container channel and seal the container, the lid bead and the container lip defining a gap, the device comprising: an elongate handle; and an opener device coupled to an end of the handle, the opener device having a groove, a tip, and a lifting surface, the tip configured to be inserted into the gap, the groove configured to mate with the container bead, the lifting surface capable of separating the lid channel from the container channel and removing the lid from the container when the handle is operated to press the groove against the container bead and press the lifting surface against a bottom of the lid bead.

DETAILED DESCRIPTION OF THE INVENTION

Figure 1A:
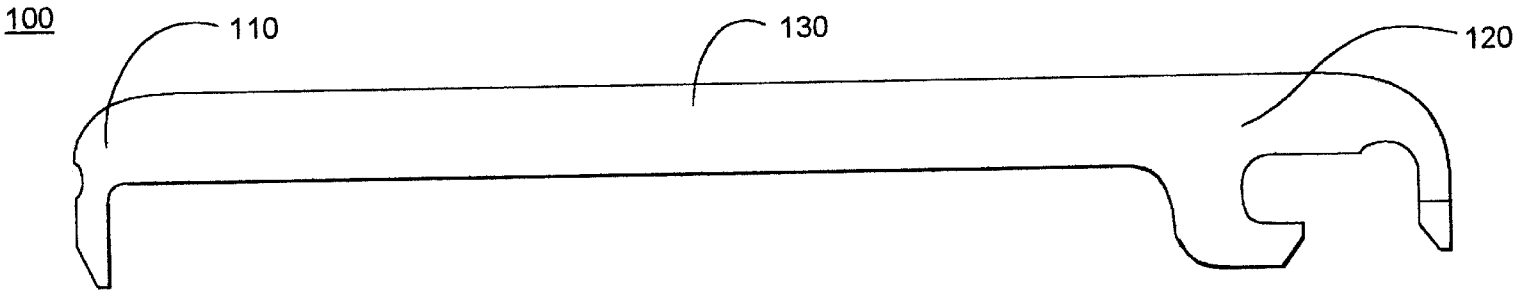
FIGS. 1A–1C illustrates one embodiment of a liquid container device of the present invention in side, bottom, and end views, respectively.
Figure 1B:
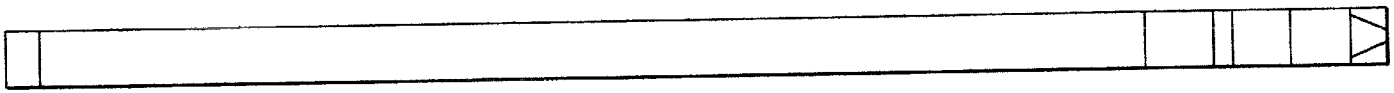
Figure 1C:
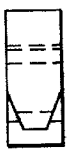

FIGS. 1A–1C show a side, bottom, and end views, respectively, of a liquid container device 100 of the present invention. Liquid container device 100 includes an opener device 110 and a puncture device 120 coupled to the two ends of a handle 130. Liquid container device 100 may also include any one or a combination of opener device 110 and puncture device 120 coupled to handle 130. For example, liquid container device 100 may have two puncture devices 120 of different sizes on the ends of handle 130. Liquid container device 100 may be made of one or a combination of aluminum, steel, titanium, plastic, or any other suitable material of sufficient strength to be capable of performing opening and puncture operations as described below. Liquid container device 100 may be manufactured by machining, extrusion, stamping, injection molding, or any other suitable manufacturing technique.

Figure 2:
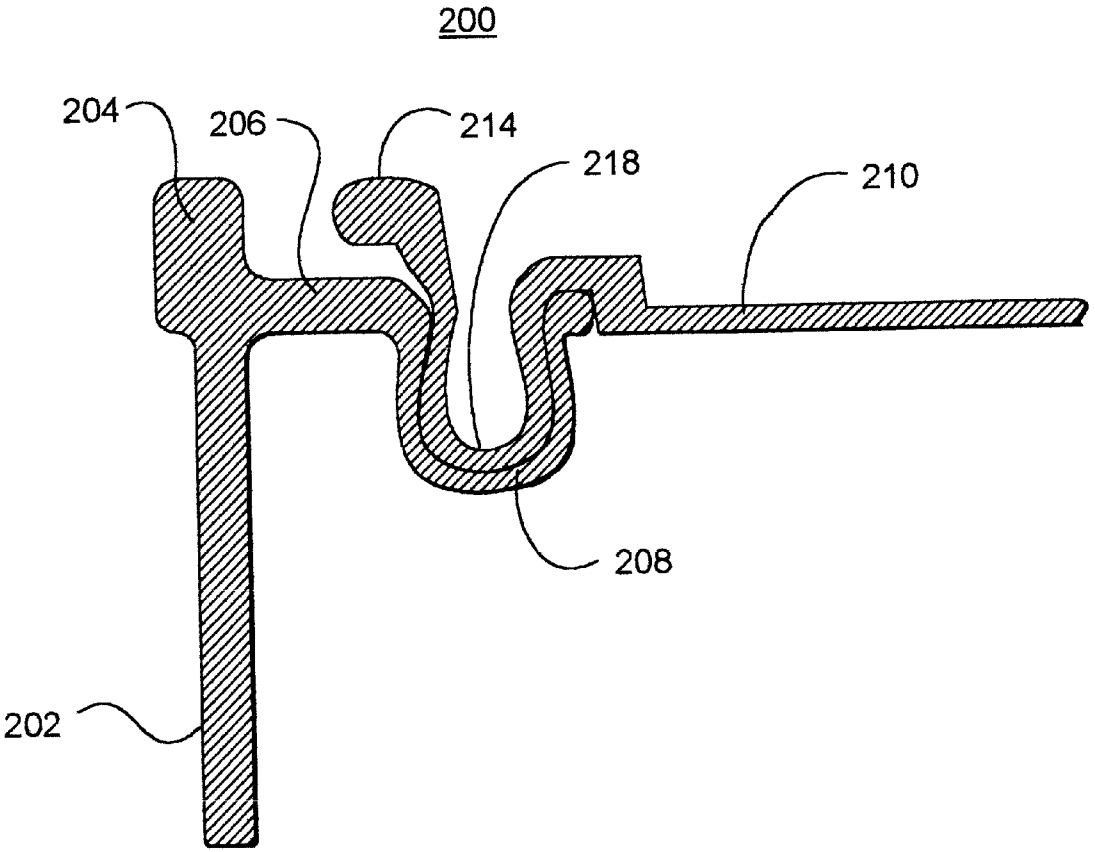
FIG. 2 illustrates the cross section of the lip and lid of a liquid container/paint can.

FIG. 2 illustrates a cross-sectional view of a liquid container 200 with a lid 210. Liquid container 200 may be a one gallon paint container or any other container with a similar lid and sealing structure. Liquid container 200 includes an outer surface 202, a container bead 204, a container lip 206, and a container channel 208. Outer surface 202 and container lip 206 meet at container bead 204. Outer surface 202 may be attached to container lip 206 with container bead 204. Lid 210 includes a lid bead 214 and lid channel 218. Lid channel 218 is configured to be inserted into container channel 208 and form a seal. Container lip 206 and lid bead 214 define a gap 220.

1. Opener Device

Figure 3A:
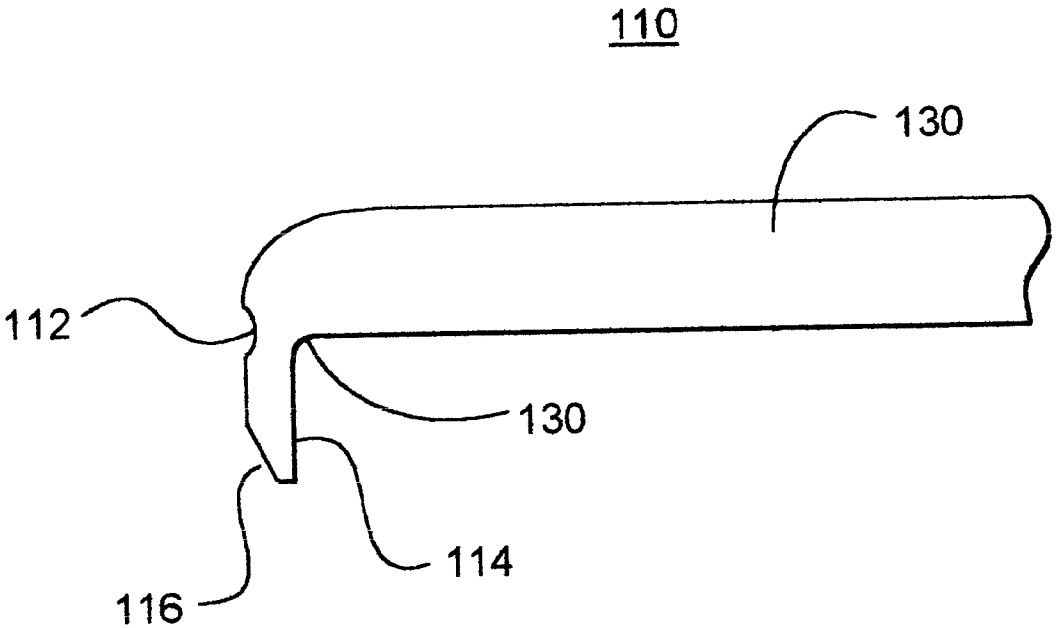
FIG. 3A illustrates a side view of an opener device.

FIG. 3A illustrates an expanded view of opener device 110. Opener device 110 includes a groove 112, a lifting surface 114, and a tip 116. Opener device 110 may be coupled to handle 130 at an angle such as a right angle, or opener device 110 may be substantially colinear with handle 130.

Figure 3B:
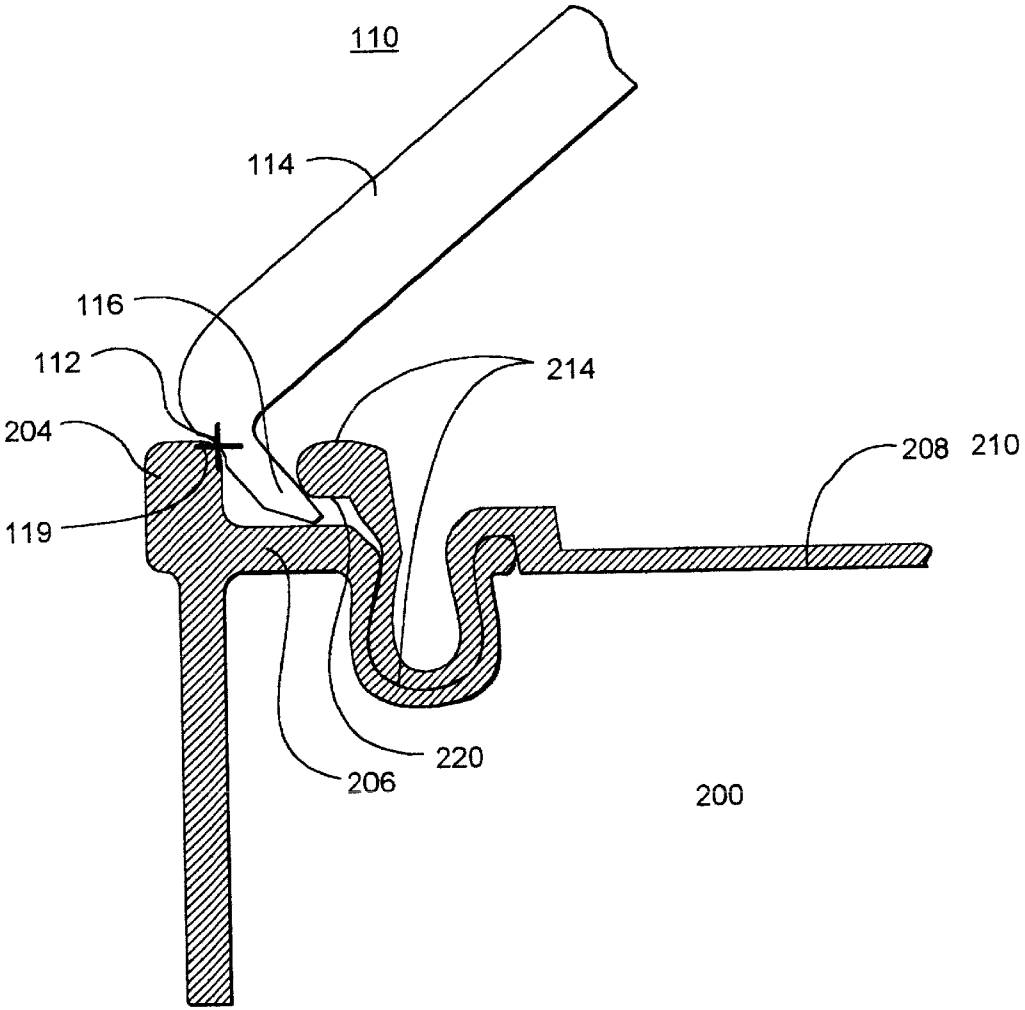
FIGS. 3B–3C illustrate the removal of a liquid container lid with the opener device of the present invention.
Figure 3C:
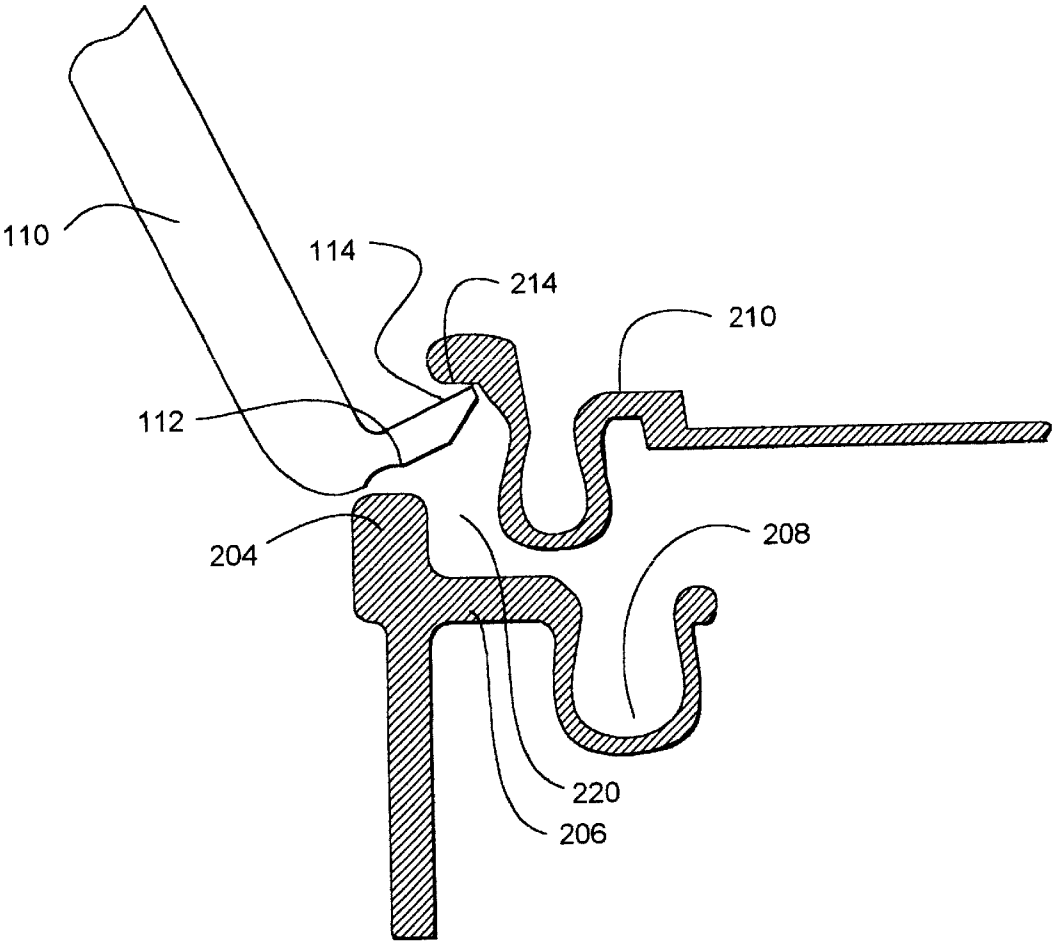

FIGS. 3B–3C illustrate the use of opener device 110 to remove lid 210 from liquid container 200. The removal of lid 210 from liquid container 200 is required to gain access to the liquid material contained therein and the removal of that liquid material. When some or all of tip 116 of opener device 110 is inserted into gap 220 defined by container lip 206 and lid bead 214, groove 112 of opener device 110 will mate with container bead 204 of the liquid container 200. An axis of rotation 119 is formed where groove 112 and container bead 204 meet. Rotating handle 130 about axis of rotation 119 will press groove 112 against container bead 204 and press lifting surface 114 against the bottom of lid bead 214. With sufficient force, this operation of handle 130 will dislodge lid channel 218 from container channel 208 and thus remove lid 210.

When at least part of lifting surface 114 is inserted into gap 220 defined by container lip 206 and lid bead 214, rocking opener device 110 in a manner so that lifting surface 114 presses up on lid bead 214 of the sealed lid 210, and with sufficient force will dislodge lid 210 out of container channel 208 of the liquid container 200. Lifting surface 114 and handle 130 act as a "see-saw" about the pivot formed by groove 112 and container bead 204.

Tip 116 may be tapered or thinned to allow easier insertion into gap 220. Lifting surface 114 may be smooth, or it may be textured to provide a better grip. Depending on the particular structure of liquid container 200 and lid 210, groove 112 is made at a distance from tip 116 such that groove 112 mates with container bead 204. The length from tip 116 to groove 112 and the length of handle 130 is selected to allow sufficient force to be generated by hand to remove lid 210. More than one groove 112 may be formed in opener device 110 to accommodate liquid containers 200 or lids 210 of different sizes.

As lid 210 starts to loosen, it may be necessary to move opener device 110 at intervals along the circumference of container bead 204 of liquid container 200 and repeat the rocking procedure until lid 210 becomes free from container channel 208 of liquid container 200. One or multiple insertions of tip 116 under lid bead 214 of the sealed lid 210, and the simple rocking back and forth of opener device 110, until lifting surface 114 pushes up on lid bead 214 of the sealed lid 210 causing lid 210 to raise out of container channel 208, will open liquid container 200. Once lid 210 is removed from liquid container 200, the liquid contents may be removed with a brush, by pouring the contents into another receptacle, or by other methods contemplated by the user of the tool.

Opener device 110 may be made in a variety of sizes, or may be sized to fit into the hand of a user. Opener device 110 has no dangerous sharp points which might easily cause physical harm to the user or others.

Opener device 110 minimizes the damage to liquid container 200 while being opened and punctured, so that, if all the liquid is not consumed in a session of use, liquid container 200 can be resealed easily and retain a competent seal.

2. Puncture Device

Figure 4A:
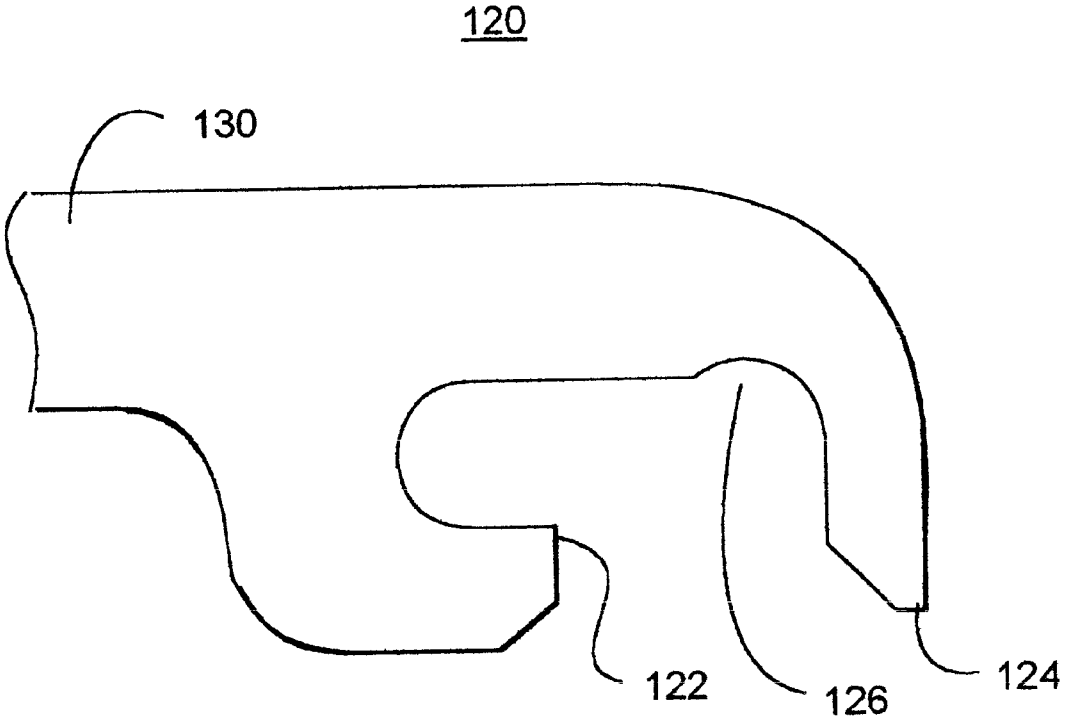
FIG. 4A illustrates the lateral view of the lip puncture portion of the present invention.

FIG. 4A illustrates an enlarged view of puncture device 120 of liquid container device 100. Puncture device 120 may be used on one gallon and one quart liquid containers/paint cans, or any other liquid container or paint cans with a suitable lid sealing structure. Puncture device 120 includes a jaw 122, a puncture point 124, and a stop 126. Puncture point 124 and stop 126 are configured to limit the depth of penetration of puncture point 124 into container channel 208 and prevent perforation of outside surface 202 of liquid container 200. Puncture point 124 is machined to be blunt and not sharp. Puncture point 124 is shaped and configured so that it can be inserted into container channel 208 without interfering with the walls of container channel 208 until it comes into contact with the wall intended to be punctured. Puncture point 124 is designed to puncture the container channel 208 in a such manner that the material which container channel 208 is made of (normally a suitable metal or alloy) will rupture peel towards outer surface 202 and minimize any exposed sharp edges which may cause accidental injury to the user (such as cuts of the fingers). Another purpose of the blunt puncture point 124 is to minimize the chance of accidental injury to the user of the tool (or others) by cuts or punctures of the skin. Jaw 122 may be smooth, or it may be textured to provide a better grip.

Figure 4B:
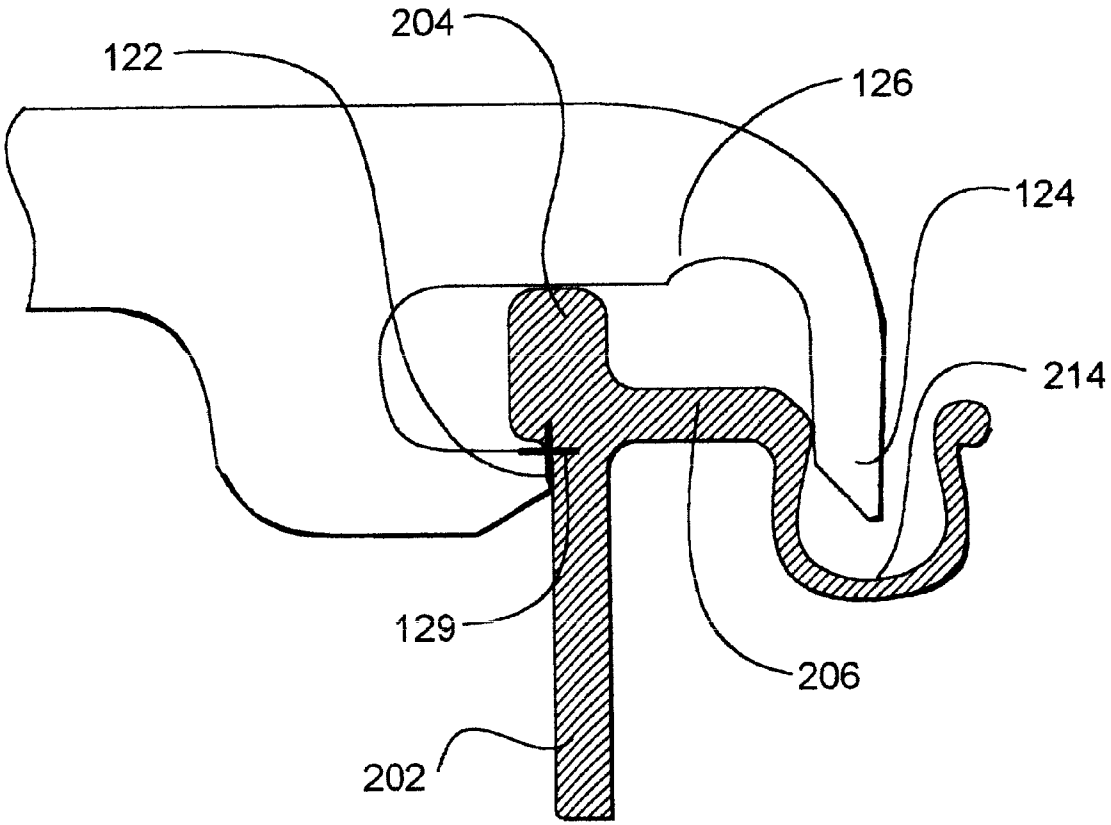
FIGS. 4B–4C illustrate the method of use of the puncture device.
Figure 4C:
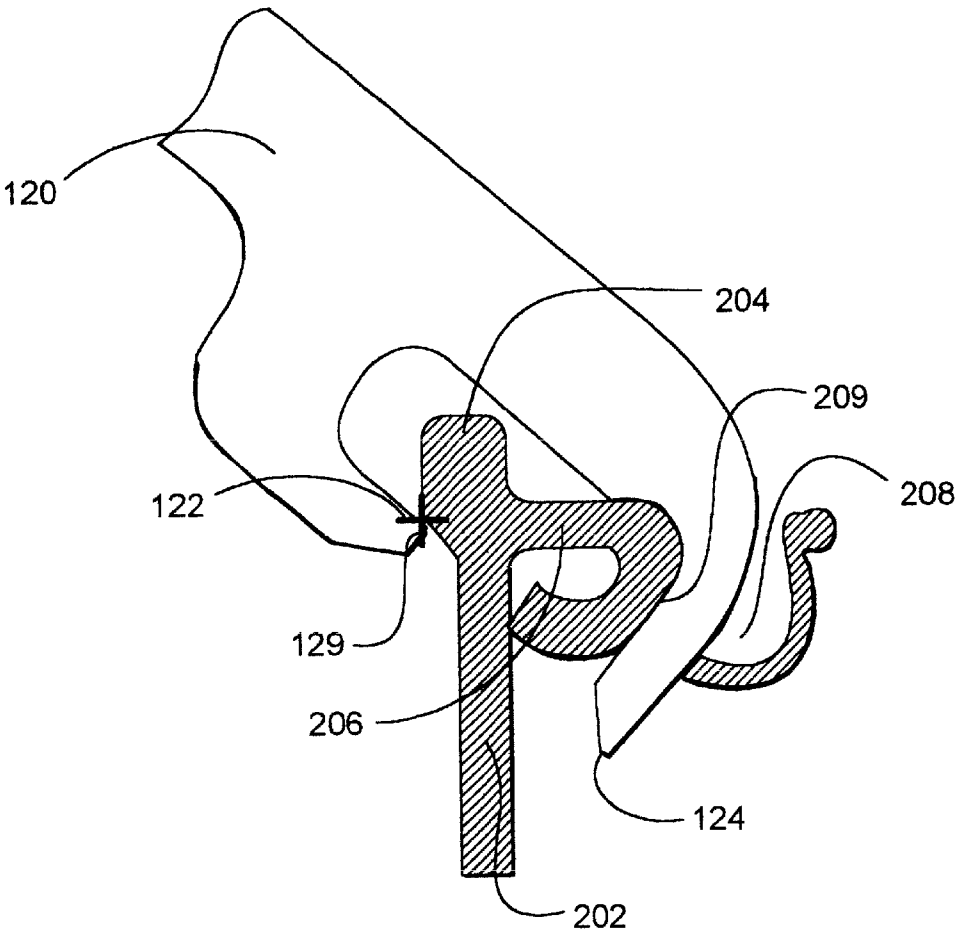

FIGS. 4B–4C illustrate the use of puncture device 120. Jaw 122 grips the edge of the can under container bead 204, while puncture point 124 is inserted into container channel 208 and punctures a wall of container channel 208 create a hole 209. With puncture point 124 inside container channel 208, jaw 122 is placed against outside surface 202 of liquid container 200 directly below container bead 204.

An axis of rotation 129 is formed where jaw 122 meets container bead 204. Rotating handle 130 about axis of rotation 129 will press jaw 122 against container bead 204 and with sufficient force, force puncture point 124 through a wall of container channel.

Holding jaw 122 against liquid container 200 in a manner so that it grips container bead 204, handle 130 is raised up until stop 126 prevents handle 130 from being raised any further. When handle 130 is raised in this manner, puncture point 124 will puncture container channel 208 and form hole 209 in container channel 208 of liquid container 200.

Hole 209 may be formed on a wall of container channel 208 closest to outer surface 202 of liquid container 200 and near the bottom of container channel 208. Hole 209 may be formed having a diameter appropriate for the width of container channel 208 and determined by the size of puncture point 124. By way of example, a hole with a diameter of about ¼' to 5/16' is suitable for use with a can of paint or other liquid material container. Stop 126 may be an indentation or a bulge, and may be adjusted so that puncture point 124 punctures container channel 208 to the desired depth and creates a hole of the desired size.

Figure 4D:
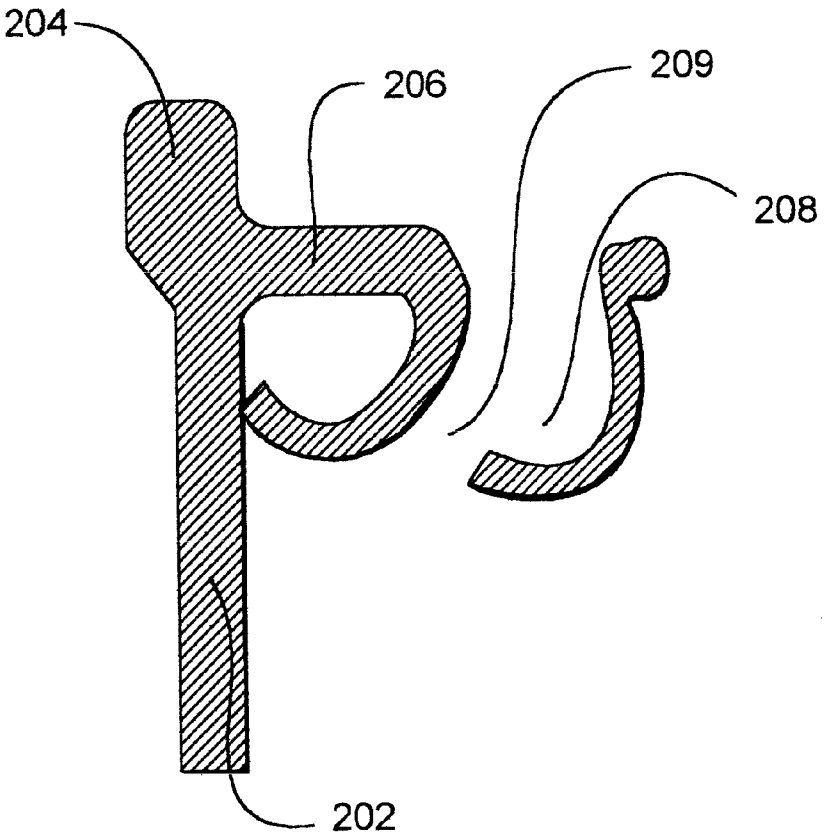
FIG. 4D illustrates the liquid container lip after puncture with the puncture jaw of the liquid container opener device.

As shown in FIG. 4D, hole 209 allows excess paint accumulation from a brush to fall back into liquid container 200 and avoids any waste or build-up in container channel 208. While a single hole 209 can achieve a sufficient amount of liquid material return to liquid container 200, any desired number of holes 209 may be formed. For example, at least one hole 209 spaced every two inches from the previous one may be formed in container channel 208. The size of liquid container 200 generally indicates the number of holes 209 that are appropriate.

Once use of liquid container 200 is completed, lid 210 may be suitably resealed with a rubber mallet or other such tool. With the formation of holes 209, lid 210 does not become stuck due to any liquid material build-up in container channel 208, since the liquid material drips back down into liquid container 200. Holes 209 are made substantially toward an outer wall of container channel 208 and toward outer surface 202 to minimize any exposed sharp edges which may cause accidental injury to the user.

Thus, liquid container device 100 may be suitably utilized with liquid containers such as paint cans to overcome problems associated with paint build-up and solidified waste in container channel 208. Of course, the principles described herein may be applied to other containers and materials, such as stains, varnishes, and the like which utilize similar liquid containers 200 and encounter the same problems with material build-up and waste.

Figure 4E:
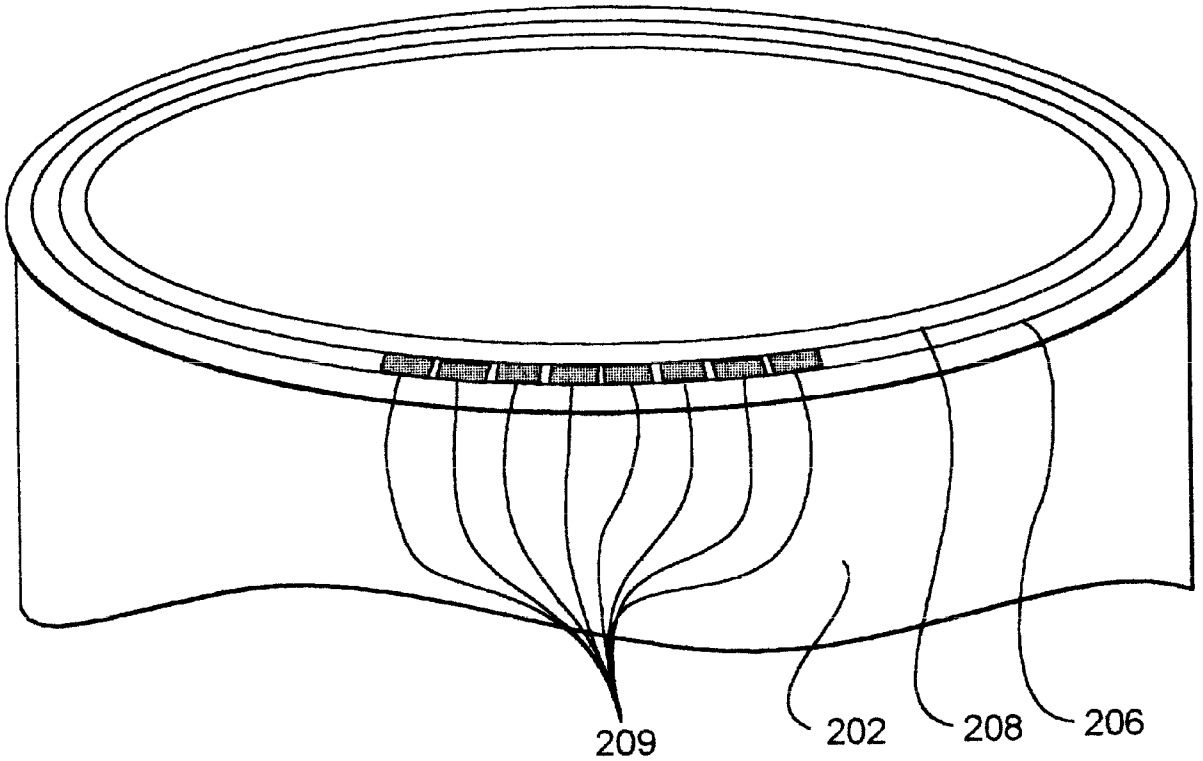
FIG. 4E illustrates the placement of several continuous holes using the puncture jaw portion of the opener device for removal of remaining liquid material.
Figure 4F:
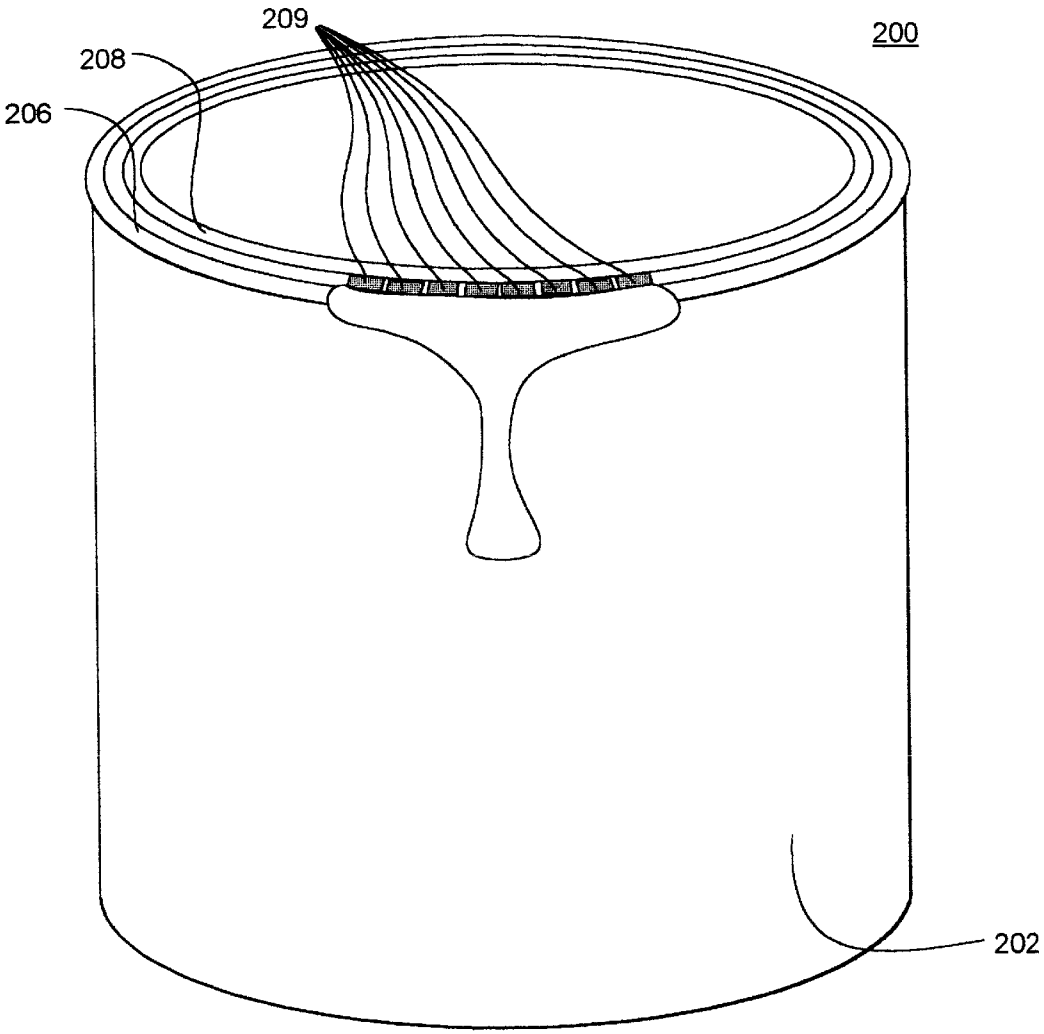
FIG. 4F illustrates the remaining liquid material in the liquid container being poured out of the continuous holes into a desired liquid receptacle.

Another use of puncture point 124 is to assist in draining the remaining liquid material from liquid container 200 once liquid container 200 is nearly empty. Puncture device 120 shown in FIG. 4E is used exactly as described earlier, except multiple holes 209 may be formed next to or continuous with each other so that they form a row of holes 209 or one larger continuous hole. Liquid container 200 may then be tipped upward making the bottom of liquid container 200 higher than container lip 206 of liquid container 200. The continuous row of holes 209 in container channel 208 are positioned so that the liquid material will flow toward those holes 209. The liquid material will flow through the continuous row of holes 209 and the remaining, hard to get portion of the liquid material will easily flow (FIG. 4F) out of liquid container 200 into the desired receptacle. By using this method as described further waste is avoided and prevented from being sent to the landfill or other waste reception sites.

The foregoing description of the invention has been presented for purposes of illustration and description. It is not intended to be exhaustive or to limit the invention to the precise forms disclosed. Many modifications and variations will be apparent. It is intended that the scope of the invention be defined by the following claims and their equivalents.

What is claimed is:

1. A device for creating a hole in a container, the container having an outer wall, a container bead, and a container lip, the outer wall meeting the container lip at the container bead, the container lip having a container channel having an outer channel wall positioned opposite an interior surface of the outer wall of the container, the device comprising:

an elongate handle having a longitudinal axis;

a jaw coupled to the handle and extending away from the longitudinal axis of the elongate handle, the jaw being configured to engage the container bead; and a puncture member coupled to the handle to form a distal end of the device, the puncture member extending away from the longitudinal axis of the elongate handle a shorter distance than the jaw, the puncture member being positioned and oriented relative to the jaw such that when the handle is operated to press the jaw against the outer wall of the container and under the container bead, a distal end of the puncture member is forced through the outer wall of the container channel.

2. The device of claim 1, wherein the container is a paint can.

3. The device of claim 1, wherein the elongate handle, the jaw, and the puncture point are one continuous piece.

4. The device of claim 1, wherein the jaw is textured.

5. The device of claim 1, wherein the jaw and the puncture point are configured to limit a depth the puncture point is forced through the outer wall of the container channel.

6. A method for creating a hole in a container having an outer wall, a container bead, and a container lip, the outer wall meeting the container lip at the container bead, the container lip having a container channel having an outer channel wall positioned opposite an interior surface of the outer wall of the container, the method comprising:

taking a device comprising an elongate handle, a jaw coupled to the handle which is configured to engage the container bead, and a blunt puncture point coupled to the handle to form a distal end of the device, the puncture point configured to be inserted into the container channel such that the puncture point punctures the outer wall of the container channel when the handle is operated to press the jaw against the outer wall of the container and under the container bead to force the puncture point through the outer wall of the container channel;

contacting the container with the device such that the jaw engages the container bead; and manipulating the elongate handle such that the jaw is pressed against the outer wall of the container and under the container bead and the puncture point is forced through the outer wall of the container channel.

7. The method of claim 6, wherein the container is a paint can.

* * * * *